United States Patent [19]

Smith

[11] Patent Number: 4,915,278

[45] Date of Patent: Apr. 10, 1990

[54] PORTABLE CONTAINER

[76] Inventor: Kenneth W. Smith, 2808 Highway 90, Gautier, Miss. 39553

[21] Appl. No.: 266,688

[22] Filed: Nov. 3, 1988

[51] Int. Cl.[4] ..... A45F 3/02

[52] U.S. Cl. ..... 224/205; 224/202; 224/236; 224/245; 224/906; 224/270

[58] Field of Search ..... 224/270, 148, 202, 205, 224/235, 236, 241, 249, 257, 151, 42.45 R, 42.46 R, 242, 245, 246, 250; 229/190, 178, 41 A; 2/49 A, 49 R, 46; 248/312, 312.1, 205.3, 359 A, 318, 311.2, 444; 206/542, 549, 478, 45.2, 45.21, 45.23; 108/43, 46; 211/89, 70.6

[56] References Cited

U.S. PATENT DOCUMENTS

| | | | |
|---|---|---|---|
| 516,247 | 3/1894 | Turck | 229/190 |
| 2,426,484 | 8/1947 | Buffenbarger | 224/151 |
| 3,061,390 | 10/1962 | Walsh et al. | 108/43 |
| 3,640,380 | 2/1972 | Huffman | 229/904 |
| 4,114,199 | 9/1978 | Malan | 2/49 A |
| 4,128,167 | 12/1978 | Hogshead, III | 229/178 |
| 4,754,903 | 7/1988 | Dennis | 224/257 |

FOREIGN PATENT DOCUMENTS

| | | | |
|---|---|---|---|
| 1803 | of 1927 | Australia | 2/49 A |

*Primary Examiner*—Linda J. Sholl

*Attorney, Agent, or Firm*—Alexander F. Norcross

[57] ABSTRACT

A box, particularly suited to enclose a food or beverage when closed, and when opened to support the food or beverage as a suspended tray from a two point harness around the neck, by providing a food carrying base, reinforcing sides to stiffen the base against folding, and the top of the box being of a stiffened material having a length significantly longer than the height of the box, so that when folded in reverse, it forms an antitilt base when the box is suspended at two points adjacent the line or fold between the top and the base by a single strap around the neck of a wearer.

3 Claims, 1 Drawing Sheet

PORTABLE CONTAINERCL BACKGROUND OF THE INVENTION

This patent deals with the field of containers for use by persons to conveniently carry small loads, especially food items, conveniently about the person, on a tray extending to the front of the carrier.

Such trays come in various forms and are well known in the art, being typified by the ubiquitous hotdog or peanut vendor at a baseball game. Varying designs for such containers have been described in the patent art.

One patent shows a form of carrier strap disclosing a double carrier harness used to hold a tray. This is U.S. No. 1,542,163 to Morde. Morde discloses a four-point harness for carrying a tray incident to disclosing an adjustable carrier strap for trays.

Other patents relate to the form of cardboard serving tray. It is believed that the closest prior art to the invention is U.S. Pat. No. 3,899,119 to Roccaforte disclosing a unitary folded construction having a top lid with a back section taller than the front lip and an internal cardboard cutout for suspending cups and the like for snack food.

Similar related structures are shown in U.S. Pat. No. 3,189,247 to Wischusen; U.S. Pat. No. 2,355,206 to Davidson; U.S. Pat. No. 3,679,971, reissued as reissue Patent No. 24233, to Goldberg; and U.S. Pat. No. 3,542,280 to Crabtree. Each of the above patents shows a different view, in detailed form, for cutting a unitary pattern within cardboard, or in the case of Crabtree, a sytrofoam, which can then be folded into a flat food receiving tray which has elevated cutout structures for supporting cups against tipping. None of the patents, save for Davidson, even mentions a lid, and Davidson's lid is simply a separate construct. None of the patents shown have any provision for placing a strap for the container or resulting container to be readily carried or used in any open position other than on a table.

The final patent to McCoy, U.S. No. 3,232,397 shows a carrying case having an enclosable lid and two straps; the McCoy device, however, may only be carried out in the closed position and does not provide a flat working surface while being suspended from its carrying strap.

SUMMARY OF THE INVENTION

The principal use of the invention is of a cardboard container which can be easily folded to a first position permitting it to be worn to hold food at a food festival or similar standing room only situation and having a second position permitting it to be closed for food carriage or for ready disposal of its contents as trash.

The container is cut so as to fold into a front angled tray with cupholder (cutout cardboard rings folding down to fit around the base of a cup) and corner holes to which a standard photo strap or neck strap can be attached.

A lid to this container is folded down behind the container extending below the bottom of the tray. The lid is a material part of the invention in that it acts as a cantilever, and provides stability, riding against the body, against front tipping of the container; this construction makes the use of a two point harness practicable. The lid can also be folded forward over the container closing it and making it a convenient closed container for carrying food to and from a location.

It is thus an object of this invention to disclose a food container of sufficient stability that it can be readily used as a table or food tray while in the carrying position.

It is a further object of this invention to disclose a container which can be easily carried by a single neck strap and which provides an open carriage and work surface suspended at a convenient height from the front of the wearer.

It is a further object of this invention to disclose a form of neck suspended, front carried tray which does not require the use of an extended strap towards the front of the tray to insure stability.

It is a further object of this invention to disclose a pattern for cutting a tray from a planar sheet of cardboard and the like, which tray can be readily suspended from the neck in a stable position using a two point harness which is clipped to the rearmost portion of the tray.

These and other advantages of the invention may be more clearly seen in the detailed description of the preferred embodiment which follows.

DETAILED DESCRIPTION OF THE PREFERRED EMBODIMENT

Figure 1:
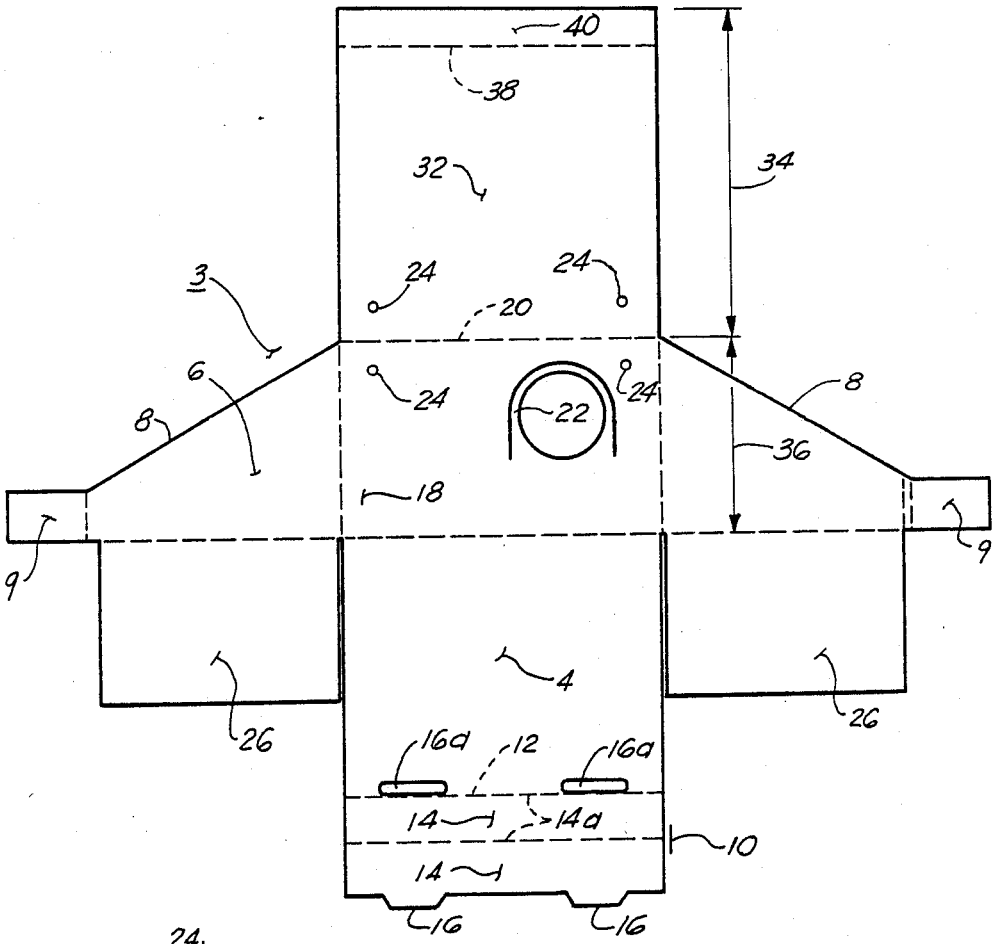
FIG. 1 is a fold pattern for the container for the instant invention.
Figure 2:
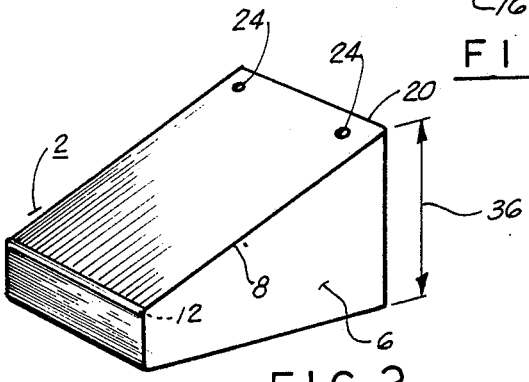
FIG. 2 is a view of the container of the instant invention with the lid closed.
Figure 3:
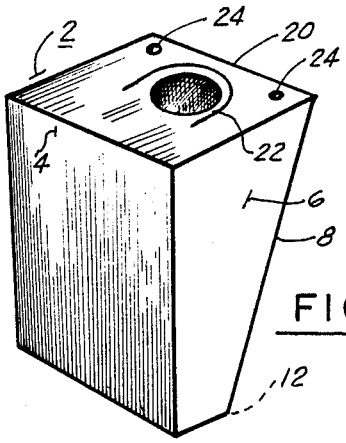
FIG. 3 is a view of the container of the instant invention showing the bottom and rear panels.
Figure 4:
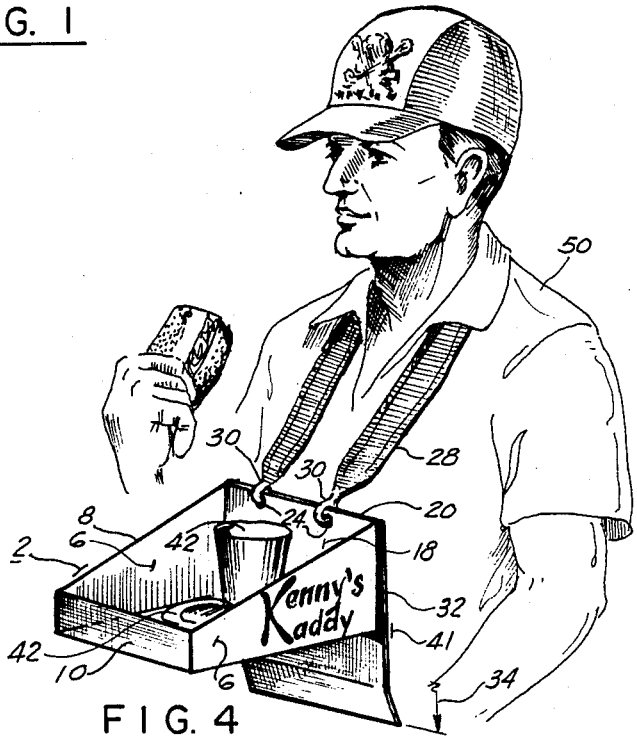
FIG. 4 is an illustrative view of the container of the instant invention in use.

Referring to FIG. 4 for an illustrative view and FIG. 1 for a detailed view, the container 2 of the current invention is shown to provide a substantially horizontal, supportive base panel 4 of generally square or rectangular aspect. Base panel 4 is reinforced against bending or folding by two sloping side panels 6, which in the preferred embodiment are of a prismatic shape defined by upper sloping edge 8 extending, in a rising manner, from a front panel section 10 to rear panel section 18.

Front panel section 10 is a relatively lower, vertical front panel defining a lower front edge 12, composed by folding in upon themselves inner fold sections 14, securing them through locking tabs 16 into the provided locking tab holes **16*a***.

Inner folding section 14 is defined by two foldlines **14*a* so as to form an enclosed section which, when the box is made up encloses and holds side panel interlock tabs 9 forming the connection of each interlocking side panel 6 into front panel 10. As a result only two locking tabs 16 fitting into their corresponding locking tab holes 16*a* are necessary, as will be seen, to fasten the entire box construction and hold the same in an assembled position from the flat container cutout pattern 3 shown in FIG. 1**.

A preferably higher rear panel 18 defines, when folded, a higher rear edge 20 to container 2. The combination of the higher rear edge 20 descending through sloping edges 8 of side panels 6 of the lower front edge 12 creates container 2 in the form of a truncated prism. It is considered that this is a desirable shape for adding strength and rigidity to the container 2 and support for base panel 4.

In the preferred embodiment, a folding cup ring 22 is cut and provided within rear panel 18 in a manner well understood. The advantage here being that folding cup ring 22 naturally tends to cause a user to place the usually heavier liquid filled cups towards the rear panel 18 when container 2 is in use.

At two points adjacent to the rear edge 20 or rear panel 18 are found suspension holes 24.

Container 2 is further provided with two inner folding base reinforcing flaps 26 so as to provide that base panel 4 will be a trebly thick base panel for additional strength and for increased resistance to liquids, which when spilled, may weaken the material of the container.

A critical component of container 2 is lid 32, attached along lid foldline 38 along rear edge 20 to rear panel 18. It is a material part of the invention that the lid length 34 is substantially longer than the height 36 of rear panel 18. Lid 32 is provided with a folding end lid lip 40 to permit lid 32 to be folded over forming a closed form of container 2.

Lid 32 is further provided with two suspension holes 24 exactly matching, in a back folded position, the position of the suspension holes 24 within rear panel 18.

Lid 32 is, while container 2 is carried on a wearer, folded back along lid foldline 38 parallel to and in contacting relationship with rear panel 18. A provided neck strap 28 is interconnected by means of removable neck strap clips 30 through suspension holes 24 suspending container 2 at two points only, and both the neck strap, and the container 2 ride adjacent to the body of the wearer 50.

In use, the container 2, constructed as described above, is clipped by neck strap clips to neck strap 28, lid 32 having been opened to the open position 41.

Container 2 is designed principally for the carrier of such things as food items 42 supporting these items upon trebly reinforced base plate 4, convenient for use by a wearer. Base plate 4 is stiffened against bending or collapse by the interlocking of front panel 10 and side panels 6 as above described, which may be further strengthened by the cantilever effect imposed by sloping edges 8 on side panel 6.

It will be expected that the weight of the food would cause the container 2 to tip in a downward direction, an effect prevented in the prior art by requiring at least four straps or by extending the neck straps and suspension straps so that they are connected at a point towards the front panel 10 to provide a balancing effect. Such an arrangement of straps is inconvenient and interferes with access to the container for the ready placement and removal of items.

In the inventive container 2, as a result of lid 32 being substantially longer in length 34 than the height of rear panel 18, lid 32 extends in a downward direction significantly below the level of base panel 4 providing a counter brace against the downward tipping of container 2. The inner surface of lid 32 rests against the body of the user 50; the resistance provided to tipping is accentuated by the inward fold or lid lip 40 against the body of the wearer. The weight of food items 42 upon the base 4 of the container 2 causes the container to attempt to pivot around the lid lip 40; this in turn attempts to pull rear edge 20 away from the body of the wearer 50, an effect restrained by the combination of the weight of the food items 42 and the rearward, two point connection to neck strap 28.

This combination of forces produces, therefore, a stable horizontal platform for the placement of small items such as food, leaving the hands free.

It is found that container 2 of the invention is of particular value in use as a casual container freeing the hands during fairs, carnivals, food fests and the like, where many food items are sold and consumed by pedestrians but where there is limited seating space or where seated eating is particularly inconvenient or unsanitary.

It is found that the form of construction of the container 2 provides for a particularly useful container having a simplified suspension system which may use commonly available neck straps such as are universally provided for cameras; the neck strap being recoverable and the container being disposable.

Thus, as the conclusion of the food fest, the neck strap clips 30 may be unfastened, lid 32 folded over the container forming a closed box, and the entire container 2 with its trash contents may then be neatly and entirely disposed of in a trash receptacle.

It is believed that this will significantly reduce the accumulation of litter, commonly seen at festivals, carnivals and the like making the container 2 both useful and convenient to the user, as well as enhancing environmental cleanup.

It can thus be seen that the container disclosed is a specific embodiment. The invention is that wider range of equivalents as are encompassed within the claims.

I claim:

1. A support device comprising:

(a) a container having a planar base surface, a rear vertical extension perpendicular to said base surface and means for supporting said base surface against substantial bending;

(b) a counter brace cover affixed to said rear vertical extension of said container at a fold line defined thereby;

(c) said counter brace cover having a first position, substantially covering said container, and a second position, contactingly abutting said vertical extension, perpendicular to said base;

(d) said cover when in said second position, extending substantially below a level defined by said base surface;

(e) a flexible strap for suspending said container from the neck of a wearer, said strap being fastened to said cover and said vertical extension when said cover is in said second position;

(f) whereby when said support device is positioned on the neck of the wearer said cover is in said second position and provides a brace to prevent tipping of said base surface.

2. A support device foldable from a unitary piece of cardboard comprising:

(a) a container having a first rectilinear base member having cut side edges and terminating in a front foldline and a rear foldline, a front panel member affixed at said front fold line further comprising to parallel first and second inwardly folding tab section members, defining a height thereof, a rear panel member affixed along said rear foldline of a greater height than said front panel member, said rear panel member bounded by first and second side foldlines perpendicular to said rear foldline and an upper foldline parallel to said rear foldline, and a first and a second slanting side panel member, each foldingly affixed along one said side foldline to said rear panel member, extending a width substantially equal to the distance between said front and said rear foldlines, terminating in an interlocking tab fold member, substantially parallel to and spaced from said side foldline;

(b) a rigid counter brace lid member foldingly affixed to said rear panel member along said upper foldline, said counter brace lid member being of a length substantially greater than the height of said rear panel member;

(c) said lid member having a first position, substantially covering said container and a second position, contactingly abutting said rear panel member, perpendicular to said base member;

(d) said lid member when in said second position, extending substantially below a level defined by said base member;

(e) a flexible strap for suspending said container from the neck of a wearer, said strap being fastened to said cover and said rear panel member when said cover is in said second position;

(f) whereby when said support device is positioned on the neck of the wearer said cover is in a said second position and provides a brace to prevent tipping of said base member.

3. A support device for supporting a load for carriage against and extending outward from the front torso of a wearer said support device comprising:

(a) a container having a substantially horizontal, supported load carrying section, and a vertically arising rear section, substantially perpendicular to the load carrying section;

(b) means upon said rear section adjacent the front torso of the wearer for connecting a flexible single strap harness for carrying said container;

(c) a substantially rigid counter brace lid member foldingly affixed along an upper line of said rear section having an open position contactingly parallel to said rear section, extending substantially below the line of said horizontal load carrying section and perpendicular to said load carrying section;

(d) a flexible strap for suspending said container from the neck of the wearer, said strap being fastened to said lid member and said means for connecting a flexible strap when said cover is in said open position;

(e) whereby when said lid member is positioned on the neck of the wearer said cover is in said open position and provides a brace to prevent tipping of said substantially horizontal supported load carrying section.

* * * * *